US007033742B2

(12) United States Patent
Roberts et al.

(10) Patent No.: US 7,033,742 B2
(45) Date of Patent: Apr. 25, 2006

(54) METHOD OF PHOTOTHERMOGRAPHIC IMAGING FOR TRANSMISSION ELECTRON MICROSCOPY

(75) Inventors: Michael R. Roberts, Rochester, NY (US); Donald L. Black, Webster, NY (US); Paul B. Gilman, Jr., Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 27 days.

(21) Appl. No.: 10/902,210

(22) Filed: Jul. 29, 2004

(65) Prior Publication Data

US 2006/0022133 A1 Feb. 2, 2006

(51) Int. Cl.
*G03C 1/498* (2006.01)

(52) U.S. Cl. ..... 430/529; 430/505; 430/350; 430/353

(58) Field of Classification Search ..... 430/529, 430/505, 350, 353
See application file for complete search history.

(56) References Cited

U.S. PATENT DOCUMENTS 6,548,236 B1 * 4/2003 Irving et al. ..... 430/505
6,576,414 B1 * 6/2003 Irving et al. ..... 430/619

* cited by examiner

*Primary Examiner*—Nikita Wells
*Assistant Examiner*—David A. Vanore
(74) *Attorney, Agent, or Firm*—Chris P. Konkol

(57) ABSTRACT

The present invention is directed to a method of forming a positive image in a photothermographic film exposed by electrons in a transmission electron microscope to form a latent image in the film. The photothermographic film has at least one imaging layer comprising a potentially negative-working emulsion, but wherein thermal development of unexposed silver salts in exposed areas relative to unexposed areas is inhibited when thermally developing the imagewise exposed assembly, thereby producing a positive image. The present invention is also directed to the processing of the photothermographic film in which a positive image characterized by high speed and discrimination is formed in the film when heated above 150° C.

20 Claims, 2 Drawing Sheets

METHOD OF PHOTOTHERMOGRAPHIC IMAGING FOR TRANSMISSION ELECTRON MICROSCOPY

FIELD OF THE INVENTION

This invention relates to the use of a positive-working silver-halide photothermographic element for transmission electron microscopy, and a process of making an image employing such element.

BACKGROUND OF THE INVENTION

The present invention relates to a method for recording an image in transmission electron microscopy (hereinafter referred to as TEM or "electron microscope"). Electron microscopes use a focused beam of electrons instead of light to image a specimen and gain information as to its structure or composition. Transmission electron microscopes pass image-forming rays through the specimen being observed. Contrast or diffracted beam images can be used to analyze the specimen or sample. Conventionally, recording of an electron microscope image has been affected with a photographic film.

More particularly, it concerns such a method of recording an image on a film element adaptable to presently existing TEM instrumentation designs without modification of the machinery and, furthermore, makes possible TEM exposure followed by immediate processing of film.

TEM instruments are capable of providing an image of a specimen with a magnification factor of up to one million times and are used extensively in such fields as medicine, biology, chemistry, metallurgy, material science, and other industrial applications for visible observation of such magnified images. Electron microscopy is also used for measuring or inspection of semiconductors or other products or components of products. Although the magnified electron image may be observed directly when focused on a fluorescent screen or by using other forms of electronic imaging devices, the resolution of detail in such directly observable images is much lower than the resolving capacity of photographic emulsions. For this reason, as well as for providing permanent records of TEM magnified images of specimens, TEM instruments are conventionally equipped with photographic film exposing systems to enable visual observation of high-resolution detail in the magnified specimen image. Moreover, final analyses of a given specimen is usually delayed until one or more photographs of the TEM image are available for observation.

TEM instruments typically comprise high power electron beam generating and focusing components, and the space or chamber in which the electrons are transmitted must be evacuated to $10^{-7}$ atmospheric pressure or more in order to avoid electron scattering by collision with molecules of air or with molecules of other substances in a gaseous phase. In this latter respect, it is to be noted that all normally liquid and even some normally solid substances may vaporize under the magnitude of vacuums developed in the electron chamber of TEM instruments. In some more advanced instruments, the film for recording the image is held at a lower vacuum (less negative pressure), for example, $10^{-5}$ rather than $10^{-7}$ mm Hg, by the use of a differential aperture positioned between the column and the "camera chamber," the latter holding the film for exposure and optionally a detector and viewing screen. In any case, whether at a lower vacuum or not, the film and film handling accessories of a TEM photographic system are typically presented in an evacuated camera chamber that receives the electron beam for exposing the film. Moreover, the film is passed into and out of the camera chamber, and each TEM instrument involves costly vacuum sealing mechanisms predicated in substantial part on the physical format of film unit assemblies employed and on the configuration of film containers or boxes to be used in a TEM instrument of a given design. Hence, modification of photographic components in presently existing TEM equipment is impractical and, moreover, design changes in photographic apparatus supplied by manufacturers of TEM instruments are restricted to accommodation of respective TEM instrument designs.

The skilled artisan will appreciate that in the present use of TEM instrumentation, the attainment of a high resolution photograph of a specimen is a very tedious and time consuming procedure by which the benefits of specimen analysis are significantly delayed. This is particularly true in the field of pathological analysis of tissue removed by surgery or in similar fields where it would be desirable to have the benefit of a TEM photograph available within a short period of time. Also, in the material sciences where electron microscopy is used for quality control or production problem solving a fast turn around time is desirable.

In TEM, conventional films employ silver-halide emulsions similar to those used based on light exposure. In films exposed with light, electron hole pairs are generated and silver specks, clusters, or latent images are generated by actinic radiation. In TEM, the electron beam interacts with the silver halide grains directly to generate the silver specks, clusters, or latent images. Although electron beams are technically not electromagnetic radiation, the net result is essentially the same. Because photographic technology involving exposure to such light or radiation is so common, such terms as "radiation," "light-sensitive" and "photography" and "light-sensitive" are often applied, respectively, to "electron beams," "electron-sensitive" and imaging based on electron exposure. Thus, such terms will be used interchangeably herein as will be appreciated by the skilled artisan.

In conventional photography, films containing light-sensitive silver-halide grains are employed in a number of image recording devices including but not limited to x-ray and electron-imaging elements. Upon exposure, the film produces a latent image that is only revealed after suitable processing. These film elements have historically been processed by treating the exposed film with at least a developing solution having a developing agent that acts to form an image in cooperation with other components in the film.

It is always desirable to limit the amount of solvent or processing chemicals used in the processing of silver-halide films. The traditional photographic processing scheme for black-and-white film involves development, fixing and washing, each step typically involving immersion in a tank holding the necessary chemical solution. By the use of photothermographic film, it is possible to eliminate processing solutions altogether, or alternatively, to minimize the amount of processing solutions and the complex chemicals contained therein. A photothermographic (PTG) film by definition is a film that requires energy, typically heat, to effectuate development. A dry photothermographic film requires only heat. A solution-minimized photothermographic film may require a small amount of aqueous alkaline solution to effectuate development, for example, an amount required to swell the film without excess solution. Development is the process whereby silver ion is reduced to metallic silver and in a color system, a dye is created in an image-wise fashion. In many photothermographic films, the silver is typically retained in the coating after thermal development.

In photothermographic films employing what is referred to as "dry physical development," a photosensitive catalyst (also an electron-sensitive catalyst) is generally a photographic-type photosensitive silver halide that is considered to be in catalytic proximity to a non-photosensitive (or non-electron-sensitive) source of reducible silver ions. Catalytic proximity requires intimate physical association of these two components either prior to or during the thermal image development process so that when silver atoms, $(Ag^{o})_{n}$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms (Klosterboer, Neblette's Eighth Edition: *Imaging Processes and Materials*, Sturge, Walworth & Shepp (eds.), Van Nostrand-Reinhold, New York, Chapter 9, pages 279–291, 1989). It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029. *Research Disclosure* is a publication of Kenneth Mason Publications Ltd., Dudley House, 12 North Street, Emsworth, Hampshire PO10 7DQ England and also available from Emsworth Design Inc., 147 West 24th Street, New York, N.Y. 10011). *Research Disclosure*, September 1996, Number 389, Item 38957 is hereafter referred to as "*Research Disclosure* I".

The non-photo-sensitive source of reducible silver ions is typically a material that contains reducible silver ions and preferably a silver salt of an organic compound.

Photothermographic (PTG) media employing dry physical development are formulated with one or more light sensitive imaging layers on a light transmitting or reflecting support. Each imaging layer typically has at least one light-sensitive silver-halide emulsion, a reducible non-light-sensitive silver salt, a developer or developer precursor, and optionally a coupler to form dye. Other components may include accelerators, toners, binders, and antifoggants known in the trade as well as components used in conventional solution-processed silver-halide photographic media. Such PTG media are similarly applicable to electron microscopy using a silver-halide emulsion, in which electrons replace light as the source of exposure.

When exposed to light or electrons (the "exposing energy") and then heated at temperatures ranging from 100 to 200° C. for 5 to 60 seconds, photothermographic media develop densities varying with exposure. The density versus log exposure curve (H&D curve) is commonly used in the trade to compare parameters such as speed and contrast. A typical procedure for generating the H&D curve entails making a contact exposure through a step tablet image. The steps modulate the intensity of the incident exposing energy such as light, usually in 0.10 to 0.30 log exposure increments. Another method entails exposing pixel-wise using a laser, CRT or LED source in which the exposure intensity is modulated electronically.

The measured reflection or transmission density of each step on the photographic media for light exposure is typically plotted against relative or absolute log exposure to produce what is known in the industry as the "H&D curve." H&D curves typically have two plateaus corresponding to the maximum density (Dmax) and minimum density (Dmin) where the slope of the H&D curve approaches or equals zero; that is, a change in exposure produces little or no change in measured density. Gamma refers to the slope of the H&D curve usually at some fixed density position. Point gamma refers to the change in density between two adjacent exposure positions in a plot of the H&D values. The mid-scale density refers to the density midway between Dmax and Dmin plateaus, or (Dmax-Dmin)/2. The corresponding exposure is designated the mid-scale exposure. In contrast, electron microscopy, rather than the use of a step tablet, an H&D curve can be obtained by making multiple exposures varying time and/or intensity. The H&D curve or response from electron exposures has an exponential shape. Whereas in light exposure, the gamma provides a measurement of contrast and is constant for a given film and processing condition, electron exposure has a constant change in gamma because of the exponential shape. Consequently, an increase of contrast is obtained by increasing density which can be obtained by exposure or changes in the processing conditions.

As used herein with respect to the present invention, the term "negative-working" refers to a photographic silver-halide emulsion that develops more density with increasing exposure up to a maximum density when an imagewise-exposed gelatin coating of the emulsion is processed using a solution-development process and concomitant materials in accordance with the well-known and conventional D-76 standard. The corresponding H&D curve has a positive (but changing) slope in the mid-scale density range when density is plotted against increasing relative log exposure. The unexposed areas develop to Dmin. The image produced in this way is referred to as a "negative image." It is to be understood that the term "negative-working emulsion" as used herein is synonymous with "potentially negative-working emulsion" and refers to an inherent capability of the emulsion that may or may not be realized in practice.

A "positive-working" photographic silver-halide emulsion, as used herein with respect to the present invention, responds to exposure by developing less density with increasing exposure down to the a lower limit (Dmin) when an imagewise-exposed gelatin coating of the emulsion is processed using a solution-development process and materials in accordance to the well-known D-19 standard. In this case, the H&D curve has a negative (but changing) slope in the mid-scale density region when density is plotted against increasing relative log exposure. The unexposed areas develop to a maximum density. The image produced in this way is referred to as a "positive image."

Materials, including solution developers, qualifying for commercially acceptable use in a D-19 standard process include Kodak's trademarked products designed for such a process. See G. Haist, "Modern Photographic Processing, Vol 1", John Wiley & Sons, Chapter 7, p 340 (1979) for the preparation of D-19 developer and other related developer formulas, hereby incorporated by reference. D-19 developer, therefore, includes any or all materials designated for and commercially used, with commercially satisfactory results in a D-19 process. Preferably, the D-19 developer is a Kodak product or one that is substantially equivalent in practice.

In a positive-working or negative-working emulsion, the developed density can comprise either silver, or if the imaging layer also contains a dye-forming coupler to react with oxidized developer, silver plus dye.

In the case of conventional solution-processed photographic media, as compared to dry or apparently dry thermally developed photothermographic media, positive images can be obtained from negative-working emulsions using combinations of multiple exposures and/or multiple development steps. See G. Haist, cited above, for details on black-and-white and color reversal-development processes, in which the following patents are cited: U.S. Pat. No. 2,005,837, U.S. Pat. No. 2,126,516, U.S. Pat. No. 2,184,013, U.S. Pat. No. 2,699,515, U.S. Pat. No. 3,361,564, U.S. Pat. No. 3,367,778, U.S. Pat. No. 3,455,235, U.S. Pat. No. 3,501,310, U.S. Pat. No. 3,519,428, U.S. Pat. No. 3,560,213, U.S. Pat. No. 3,579,345, U.S. Pat. No. 3,650,758, U.S. Pat. No. 3,655,390, BR 44248, BR 1151782, BR 1155404, BR 1186711, BR 1201792, CA 872180, and CA 872181.

For example, photobleach emulsions can be used in conventional solution-developed silver-halide photographic media to produce positive images. These emulsions are prepared with desensitizing dyes and chemical fogging agents. An exposure destroys preformed surface fog centers rendering the grains undevelopable. The unexposed grains develop to form a positive image. G. Haist reviews this topic in *Modern Photographic Processing*, Vol 2, Chapter 7, John Wiley & Sons, (copyright 1979).

Commonly assigned copending application Ser. No. 10/460,142, Filed Jun. 12, 2003, relates to a positive-working silver-halide photothermographic film that can be exposed by various forms of energy including ultraviolet and infrared regions of the spectrum as well as electron beam and beta radiation, gamma ray, x-ray, alpha particle, neutron radiation and other forms of corpuscular wave-like radiant energy. The film can be use for high speed black and white film, including consumer camera film, x-ray film, dental film, and dosimeters.

Positive-working photographic silver-halide emulsions are not generally used for imaging in electron microscopy. There are no known positive-working photothermographic silver-halide emulsions that are sensitive to focused electron-beams.

Also, a significant problem with photothermographic elements has been the difficulty obtaining high photographic speeds. Organic solvents may degrade photographic efficiency. Methods of chemical and spectral sensitizations in organic solvents are less effective than in water for similar reasons. Gelatin coatings, on the other hand, are more difficult to thermally develop due to the physical properties of the gelatin when it is heated. Lower developed density and photographic speed generally result from the higher glass transition temperature of gelatin and generally slower rates of diffusion of developer components in the strong hydrogen bonding polypeptide matrix. Gelatin coatings also require dispersing the incorporated water-insoluble developer components, which causes them to react generally more sluggishly under thermal processing conditions compared to organic solvent coatings in which developer components are dissolved in the coating solvent.

The prior art describes photothermographic systems that produce negative images that are nearly equal in speed to those obtained with solution development. In contrast, the present invention can produce direct-positive photographic speeds that are significantly greater than speeds obtained by solution or thermal development of same-size negative-working silver-halide emulsions.

SUMMARY OF THE INVENTION

The present invention is directed to a method of using a focused beam of electrons in an electron microscope to form an image in a positive-working photothermographic element or material, such as film, comprising a potentially negative-working emulsion but in which fog-density development in exposed areas of the image is imagewise inhibited upon thermal development. By "fog density" is meant the thermal development, in the emulsion, of unexposed silver particles, whether light-sensitive and/or non-light sensitive silver-containing particles. The image can be monochrome or bichrome. Without wishing to be bound by theory, it is believed that imagewise inhibition occurs by the presence of an inhibiting agent or precursor thereof, for example, an inhibitor-releasing compound that releases a density inhibitor upon thermal development.

In accordance with the present invention, a photographic system is made available for existing TEM instrumentation by which a film emulsion may be exposed to the magnified TEM image and processed immediately thereafter. The system employs a combination of film sheet carrier plates or holders and film-unit handling apparatus which is adaptable to all known TEM instrumentation and by which exposed film sheets may be processed automatically in a single film processor.

The film sheet carriers used in the method of the invention are of an exterior configuration duplicating existing carriers of diverse TEM designs to enable unimpaired use thereof in existing machines. The film sheet retaining structure of the carriers, however, is standardized to enable automated separation of individual exposed film sheets from the respective carriers in the processor.

The diverse designs of receiver boxes used with existing TEM instruments are retained by the provision of a transfer box equipped with an adaptor base shaped to cooperate with the receiver box of a given existing design and to cooperate with a film unit feed mechanism in the processor. While the use of a transfer box minimizes handling of the TEM receiver box and is thus preferred, it is contemplated that the receiver boxes of the several existing designs may be provided with an adaptor top to enable direct placement of the receiver box into the film processor. In another embodiment of the present invention, a single box can be used for both supply of the unexposed film and return of the exposed film.

The film processor is a compact self-contained unit having an exterior console or cabinet-like enclosure and is capable of placement next to a TEM instrument or centrally in relation to several such machines. The processor is designed to receive and cooperate with the transfer box in a manner to enable complete film processing. Once in the processor, the opened base of the transfer box is positioned in operative relation to a reciprocating slide feed mechanism by which each individual film unit is ejected from the box, the film sheet separated from the carrier plate, assembled with processing materials and advanced to the nip of a processing roller pair. Retraction of the slide feed mechanism deposits the empty carrier plate in a receptacle for removal and subsequent reuse. Processing supplies in the processor are preferably in web form to facilitate continuous feed from supply spools to a take-up spool. Each individual film sheet is separated from the processing webs to be available at an access door in the processor cabinet.

Among the objects of the present invention are, therefore, the provision of a photographic system enabling the use of photothermographic film in existing TEM instrumentation; the provision of such a system which requires no modification to the existing TEM instrumentation; the provision of such a system which is adaptable to diverse types of TEM instrumentation without modification thereof; and the provision of such a system which reduces significantly the time and handling requirements of existing TEM photographic systems. Other objects and further scope of applicability of the present invention will become apparent from the detailed description to follow taken in conjunction with the accompanying drawings in which like reference numerals designate like parts.

The object to be imaged is placed between the film unit and the source of focused electrons. The object modulates the electron beam to produce an electron transmission image that penetrates the film in the film unit. The electron energy is recorded by the photothermographic element in the form of a latent silver image. During thermal development of the photothermographic element, a density-inhibiting agent inhibits thermal fog development in the exposed areas relative to the unexposed areas of the element, to produce a positive image in the photothermographic film.

In a preferred embodiment, one or more couplers or the like is present in the photothermographic element to accelerate development by removing Dox as it is formed, in order to drive development to Dmax.

Without wishing to be bound by theory, it is believed that thermal development in the present invention comprises (in order) two stages: a first stage comprising amplification of the latent image to form a relatively low-contrast negative image; and a second stage comprising imagewise inhibition of fog development (by an agent released by an inhibitor-releasing compound) to form a final relatively high-contrast positive image.

The present invention is also directed to a photothermographic element that can be used in the present process.

The present invention has the advantage of higher speed. In fact, the above-mentioned second-stage positive image, taken to full development in the unexposed areas, is potentially at least one stop faster than the first-stage negative image. Thus, the inventive method and accompanying photothermographic element can form a positive image of high speed and discrimination when exposed and heated 10 to 40 sec at 150 to 185° C. Images have excellent thermal and light stability. Minimum densities are stable after extended incubation to heat or light. These and other advantages will be apparent from the detailed description below.

Definitions of other terms, as used herein, include the following:

In the descriptions of the photothermographic materials of the present invention, "a" or "an" component refers to "at least one" of that component.

Heating in a substantially water-free condition as used herein, means heating at a temperature of from about 150° C. to about 200° C. with little more than ambient water vapor present. The term "substantially water-free condition" means that the reaction system is approximately in equilibrium with water in the air, and water for inducing or promoting the reaction is not particularly or positively supplied from the exterior to the material. Such a condition is described in T. H. James, *The Theory of the Photographic Process*, Fourth Edition, Macmillan 1977, p 374.

"Emulsion layer," "imaging layer," or "photothermographic emulsion layer," means a layer of a photothermographic material that contains the photosensitive (in this case, electron sensitive) silver halide and non-photosensitive (non-electron-sensitive) source of reducible silver ions.

"Non-photosensitive" means not intentionally sensitive to light or electrons.

The term "organic silver salt" is herein meant to include salts as well as ligands comprising two ionized species. The silver salts used are preferably comprised of silver salts of organic coordinating ligands. Many examples of such organic coordinating ligands are described below. The silver donors can comprise asymmetrical silver donors or dimers such as disclosed in commonly assigned U.S. Pat. No. 5,466,804 to Whitcomb et al. In the case of such dimers, they are considered to be two separate organic silver salts such that only one silver atom is attributed to each organic silver salt. Organic silver salts can be in the form of core-shell particles as disclosed in commonly assigned U.S. Pat. No. 6,548,236.

The terms "blocked developer" and "developer precursor" are the same and are meant to include developer precursors, blocked developer, hindered developers, and developers with blocking and/or timing groups, wherein the term "developer" is used to indicate a reducing substance for silver ion.

"Non-photosensitive" means not intentionally light or electron sensitive.

"Transparent" means capable of transmitting visible light or electrons without appreciable scattering or absorption.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

To facilitate understanding, identical reference numerals have been used, where possible, to designate identical elements that are common to the figures.

DETAILED DESCRIPTION OF THE INVENTION

Figure 1:
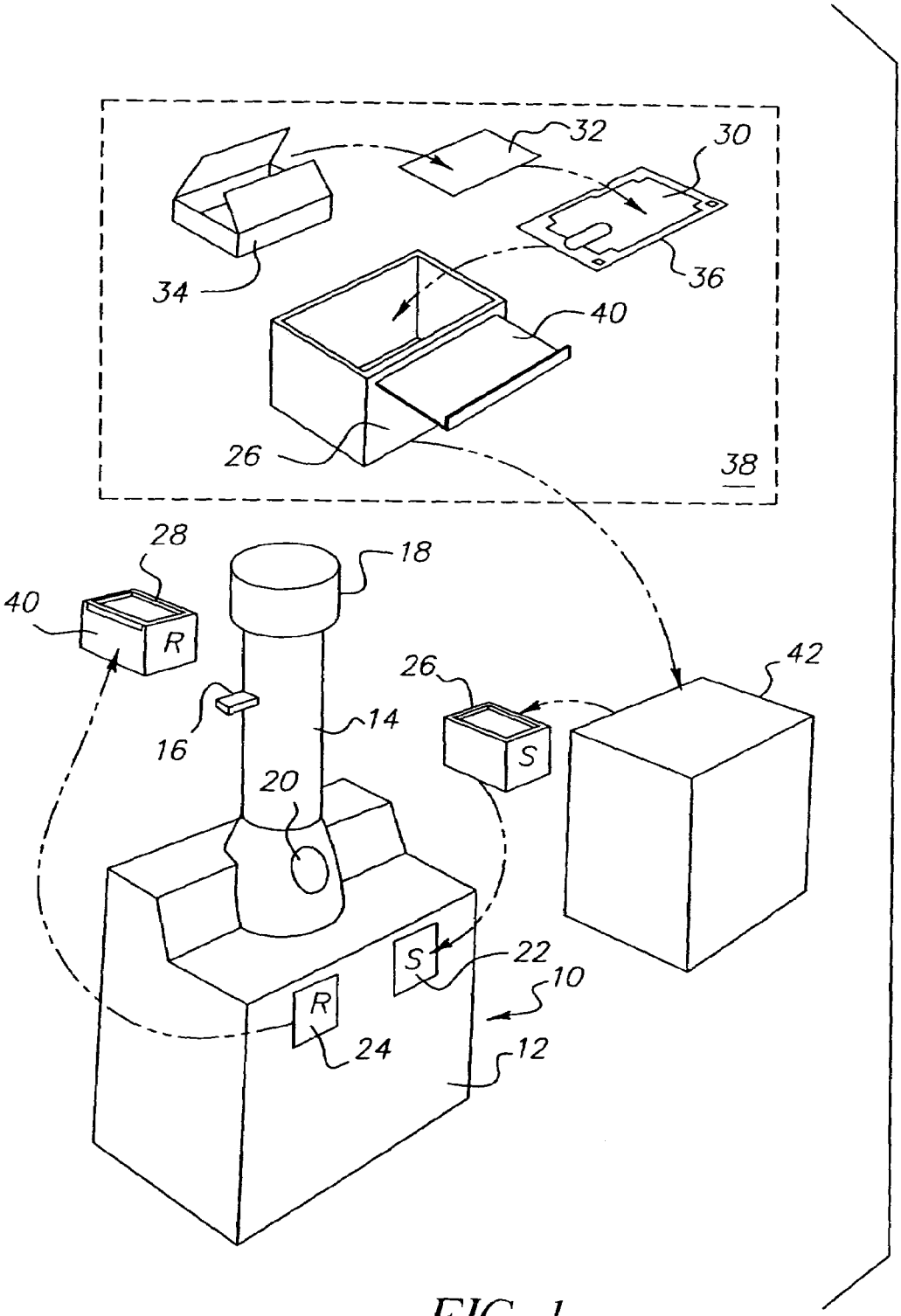
FIG. 1 (PRIOR ART)
FIG. 1 is one embodiment of a conventional (prior art) TEM instrument including a cabinet-like base on which is mounted an electron beam focusing column.
Figure 2:
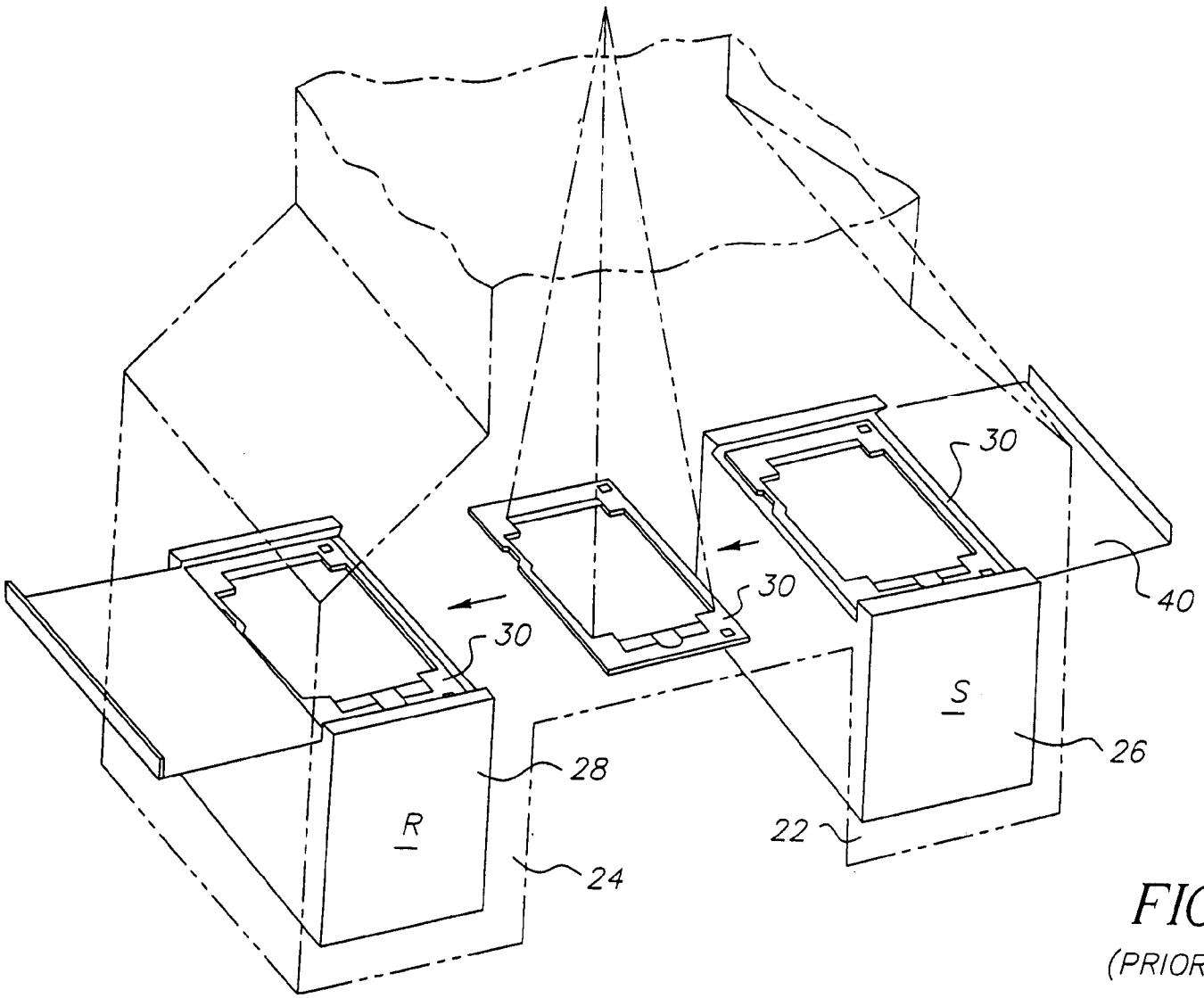
FIG. 2 (PRIOR ART)
FIG. 2 illustrates film boxes, in one embodiment, as they might be oriented within the TEM instrument of FIG. 1, including individual film units that are transferred from the supply box to an exposure station aligned with the focusing column and then to the receiver box.

To provide a general understanding of existing TEM instrument design and the procedures required in the handling of photographic film to be used in such machines, a brief description will now be made. In FIG. 1, the various photographic equipment and handling procedures in a conventional research laboratory are schematically represented. In FIG. 2, the transfer of individual film units within the TEM instrument is diagrammatically depicted. In an alternative embodiment that is conventionally used in some TEM systems, a single box can be used to provide both the film supply and the return of the exposed film, as known by the skilled artisan.

In FIG. 1, TEM instrument 10 is shown to include a cabinet-like base 12 on which is mounted an electron beam focusing column 14 having a specimen receptor 16. An electron beam generating head 18 is located at the upper end of the column 14. The function of the electron beam generating head 18, often referred to as an electron gun, is to provide an intense beam of high energy electrons. There are two main types of gun, a thermionic electron gun, which is the most commonly used, and a field emission gun. In the thermionic electron gun, electrons are emitted from a heated filament and then accelerated towards an anode. A divergent beam of electrons emerges from the anode hole. In the field emission gun, a very strong electric field ($10^9$ $Vm^{-1}$) is used to extract electrons from a metal filament.

In the TEM, higher energy electrons permit the examination of thicker specimens, but may cause specimen damage. Higher voltage microscopes are also more expensive. The accelerating voltage of the transmission electron microscope, the range of voltage used to produce electrons for imaging, is 100 keV to 1 MeV. Most TEMs have a voltage of 20 kV to about 200 kV. A thin specimen is illuminated with a fine beam of high energy primary electrons typically 20 keV or higher, of precisely controlled energy produced by an electron gun.

In one embodiment, the transmission electron microscope typically comprises, in addition to an electron gun, an illuminating lens system for illuminating or irradiating a specimen, or object to be imaged, with an electron beam from the electron gun, and an image formation lens system for forming an enlarged transmission image of said specimen in the photothermographic film positioned in the camera chamber.

Electromagnetic lenses in the electron beam focusing column 14 are the magnetic equivalent of the glass lenses in an optical microscope. The behavior of electron lenses in a TEM can be approximated by the action of a convex (converging) glass lens on monochromatic light. The lens is basically used either to take all the rays emanating from a point in an object and recreate a point in an image or to focus parallel rays to a point in the focal plane of the lens. The electromagnetic lenses are typically provided by a strong magnetic field that is generated by passing a current through a set of windings. This field acts as a convex lens, bringing off-axis rays back to focus.

An electron transmission microscope is typically capable of a magnification (the ratio of the size of an image to its corresponding object) of at least 5000, preferably greater than 10,000 or more. In one embodiment, the transmission electron microscope is capable of a total magnification in the range of 2,500× to higher than 25,000×. In another embodiment, a transmission electron microscope is capable of a total magnification in a range of 25,000× to 800,000× or greater. The adjustment of magnification is typically effected by means of a control unit that includes customary controls for operation of an electron microscope. The details of the control unit are not important for the purposes of the present invention.

An observation port 20 is customarily provided for viewing a fluorescent plate (not shown) at the base of the column. The cabinet-like base 12 includes a pair of drawers 22 and 24 for receiving respectively a film supply box 26 and a film receiver box 28. In FIG. 2, the film boxes 26 and 28 are shown as, in one embodiment, they might be oriented within the TEM instrument 10. Typically, mechanisms (not shown) are present for transferring individual film units 30 from the film supply box 26 to an exposure station aligned with the focusing column 14 and then to the film receiver box 28. The evacuated camera chamber of the TEM instrument 10 is generally depicted in phantom lines in FIG. 2 and as such encloses both boxes 26 and 28 within the TEM instrument 10.

A film handling procedure now used in TEM laboratories is diagrammatically depicted in FIG. 1 of the drawings. Individual film sheets 32 are removed from a shipping carton 34, manually inserted into a machine compatible carrier plate or holder 36 to provide a film unit 30. The film units 30 are then loaded into a supply box 26 to complete a film preparation procedure carried out in total darkness within a darkroom 38 or an appropriate safe light. In larger TEM laboratories, as many as 8 or more TEM instruments 10 may be serviced by a single or central darkroom. Also, it is not uncommon for a laboratory to employ the TEM instruments of two or more different manufacturers, each of which requires a unique carrier plate or holder 36, supply box 26, and receiver box 28. Both boxes 26 and 28 employ a light-tight cover or "dark slide" 40 or the like, the dark slide 40 of the supply box 26 being closed in the darkroom 38 after it is filled with film units 30.

Prior to use in TEM instrument 10, the loaded supply boxes 26 must be out-gassed in a vacuum chamber 42 to assure removal of volatile substances that may vaporize in the vacuum chamber of the TEM instrument. As explained above with reference to FIG. 2, in the TEM instrument 10, a specimen is inserted into the column 14 and photographed by passing the individual film units 30 from the supply box 26 to position for exposure and then to the receiver box 28.

It is desirable with some types of specimens to expose only a few film units 30 and then remove the receiver box 28 (with only the few exposed film units) and return it to the darkroom for development so that the developed images may be observed prior to making further exposures of electron images of the same specimen. In fields such as medicine or where other biological specimens are under observation, the time required for conventional film handling development is often longer than the viable life of the specimen under vacuum. Hence, it is customary to await development of film until the receiver box 28 is filled.

Features often present in electron microscopes are digital displays, computer interfaces, image-analysis processing software and low vacuum or variable pressure chambers that allows a pressure differential between the high vacuum levels required in the gun and column area and the relatively low pressures used in the camera chamber.

As mentioned above, the present invention is directed to a photothermographic element for an electron microscope. According to the method of the present invention, a positive image is formed in the photothermographic element (such as film), comprising a potentially negative-working emulsion, by employing an inhibitor-releasing compound that imagewise inhibits fog-density development in exposed areas of the image during thermal development.

According to the method of the present invention, thermal development of unexposed silver salts in the exposed areas is inhibited relative to the unexposed areas, with the proviso that the element is imagewise exposed with a non-solarizing amount of exposing energy ion from focused electron-beam in order to form a latent image, and the latent image is thermally developed in a single development step, without any reversal steps or additional exposures to actinic electron-beam, to produce a positive image in the film. The above-mentioned inhibition is believed to be caused by a density-inhibiting agent that may be present or released during thermal development, for example, released by a density-inhibitor-releasing compound (as in believed to occur in a preferred embodiment) but, in any case, the key is that inhibition is accomplished.

In another aspect of the present invention, a photothermographic element, comprising at least one image-forming layer coated on a support, said layer comprising at least one photographically active silver-halide emulsion sensitive to visible light and at least one non-light-sensitive organic silver salt, following imagewise exposure to an electron-beam, is developed by heating at 150–200° C., to develop an imagewise reduced-silver image that is physically separate and morphologically distinct from the developed latent-image silver associated with the silver-halide grains. In one preferred embodiment, the photothermographic element comprises at least one non-light-sensitive organic silver salt that releases the inhibitor-releasing compound.

In the preferred embodiment, at least one imaging layer comprises a negative-working silver-halide emulsion, at least one non-light sensitive silver salt, an inhibitor-releasing compound, a developer or precursor thereof, and preferably a scavenging agent for the oxidized developer Dox.

In one preferred embodiment, for example, at least one imaging layer comprises a negative-working silver halide emulsion, at least one non-light-sensitive silver salt which functions as an inhibitor-releasing compound, a blocked phenylenediamine developer, a phenolic developer/coupler, and a thermal solvent, for example, a hydroxy-substituted benzamide. One may also incorporate optional toners and accelerators known in the trade, examples of which include succinimide, phthalimide, naphthalimide, phthalazine, and phthalazinone. Other components that can be used are described in U.S. Patent Publication 2004/0033447 A1, hereby incorporated by reference it its entirety.

After exposure to an electron beam the photothermographic emulsion develops a positive image when the exposed invention element is heated at a temperature of at least 150° C. for at least 20 sec, preferably at least 155° C. for at least 20 sec, most preferably 160° C. for 20 to 40 sec. Images can be formed having excellent discrimination and are resistant to print out. To Applicants' knowledge, this is the first example of photothermographic element incorporating a negative-working emulsion that develops a positive image when given a non-solarizing exposure, or requiring multiple development steps as in reversal development. In contrast, a solarizing exposure is an extended exposure beyond the level required to produce a stable latent image. Less density develops in this case because the extended exposure causes the release of sufficient halogen to oxidize the latent image. By the phrase "absence of multiple development steps" is meant that development occurs in a single unit-process step. Full development can occur during a heating step wherein once the film is heated to initiate development the development is complete before bringing the film back to temperature below which thermal development is initiated. For example, in one embodiment, the development is initiated above 150° C. and completed before bringing the temperature below 150° C. There are no separate reversal steps, or exposures of the photographic element, for complete development. Instead, thermal development, involving both a relatively low-contrast negative image and its change to a final positive image, occurs in a single or continuous heating step.

Without wishing to be bound by theory, the Applicants believe the following events occur during the present process. In an initial stage of thermal development, latent image amplification occurs in the normal sense to produce a low-contrast negative image. During this initial stage, a development inhibitor is released. The inhibitor is believed to shut down negative-image development shortly after initiation. In a second stage of thermal development, in which unexposed silver halide and non-light-sensitive silver salts are thermally developed or reduced to silver (referred to as "fogging") at sufficiently high temperature, the developed density in the initial negative-image development stage becomes the Dmin of the final positive image. A coupler, if present, may react with oxidized developer to form a negative image consisting of dye plus silver. Colors can appear quite saturated in the negative image. With continued heating the exposed areas resist further development while the unexposed areas rapidly develop to a high-density fog.

If a coupler is present, the hue may appear less saturated in the unexposed areas. The result is a positive two-toned image possessing high speed and excellent light stability, suitable for scanning or, in some cases, for direct viewing.

Electron micrographs reveal that, during the second stage of thermal development, some of the silver development can occur off-grain and may involve the photographically inactive non-halide silver ion donors during dry physical development. Increasing exposure of the negative-working photosensitive silver halide grains results in less off-grain silver development. This provides the advantage of increased covering power and developed density in the areas of least exposure.

Without wishing to be bound by theory, the Applicants postulate that positive-image development occurs via formation of a sphere of inhibition around the exposed and partially developed negative-working silver-halide grains.

In a preferred embodiment, two different silver ion donors are present in the imaging layer, one or both of which release a development or density-inhibiting agent. However, other sources of the development inhibitor can be used, for example, as a PUG (photographically useful group) that is releasable from a coupler or other compound present in the imaging layer. For example, in one embodiment of the invention, phenylmercaptotetrazole (PMT) or benzotriazole, two known development inhibitors commonly used in the trade to make DIR couplers (development-inhibitor-releasing couplers), are believed to accumulate during the initial stage of dry physical development in the vicinity of the partially amplified negative image, when only the latent image develops. It is postulated that at a critical concentration, the inhibitor shuts down further latent-image development and also slows the rate of fog formation or development in the exposed areas. The unexposed areas appear to produce fog at a normally high kinetic rate, fast enough to develop to a high density before released inhibitor can shut down development. The result is a positive image having high discrimination and speed.

In a preferred embodiment, the photographic speed of a given negative-working emulsion in the dry-reversal coating format is at least one stop higher in photographic speed compared to conventional solution-processed or thermal-processed coatings that produce a negative image. Images are quite stable to extended exposure to light.

In one embodiment of the invention, in which the photographic element comprises two organic silver salts, the first organic silver salt exhibits a pKsp difference of at least 0.5, preferably at least 1.0, more preferably at least 2.0 less than the pKsp of the second organic silver salt or ligand. In one particularly preferred embodiment, the first organic silver ligand exhibits a cLogP of 0.1 to 10 and a pKsp of 7 to 14 and the second organic silver ligand exhibits a cLogP of 0.1 to 10 and a pKsp of 14 to 21. In another embodiment, the first organic silver salt, or salt of the first type, has a pKsp of 9 to 16 and the second organic silver salt, or the organic silver salt of the second type, has a pKsp of 12 to 19.

In another embodiment, the organic ligands used to make the first and second silver salts are combined together to form a single mixed silver salt of various molar compositions.

When individual organic silver salts are used, both organic silver salts are present at levels above 5 g/mol of imaging silver halide. Preferably, the first organic silver salt is primarily the silver donor during the initial stage of thermal development (or the more reactive silver donor), at levels in the range of 5 to 3,000 g/mol of imaging silver halide. Preferably, the second organic silver salt acts as the thermal fog inhibitor, in the first stage of thermal development, and is present at levels in the range of 5 to 3,000 g/mol of imaging silver halide. Preferably, molar ratio of said first organic silver salt to said second organic silver salt is from about 0.1:10 to about 10:1.

In a preferred embodiment of the present invention, a photothermographic element has on a support one or more one electron-sensitive imaging layers, each of said imaging layers comprising an electron-sensitive silver emulsion, a binder, a dye-providing coupler or other Dox scavenger, and a developer or blocked developer. Preferably, the dyes or other compounds formed from the Dox scavenger in the layers are capable of forming a dye image of a visible or non-visible color. The term "visible or non-visible colors" is defined as colorless compounds may absorb light outside the visible wavelength region (400–700 nm).

Although the minimum value of the indicated difference in pKsp is 0.5, preferably the difference in pKsp is at least 1.0, more preferably at least 2.0. The lower the temperature onset, however, the less the difference in pKsp that is needed. In one embodiment of the invention, both the first and second organic silver salt, or both the first and second type of organic silver salt, have a pKsp of greater than 11, preferably greater than 12, and neither are silver carboxylates, including silver behenate.

The activity solubility product or $pK_{sp}$ of an organic silver salt is a measure of its solubility in water. Some organic silver salts are only sparingly soluble and their solubility products are disclosed, for example, in Chapter 1 pages 7–10 of *The Theory of the Photographic Process*, by T. H. James, Macmillan Publishing Co. Inc., New Your (fourth edition 1977). Many of the organic silver salts consist of the replacement of a ligand proton with Ag+. The silver salts derived from mercapto compounds are relatively less soluble. The compound PMT has a $pK_{sp}$ of 16.2 at 25° C. as reported by Z. C. H. Tan et al., *Anal. Chem.,* 44, 411 (1972); Z. C. H. Tan, *Phototgr. Sci. Eng.,* 19, 17 (1975). In comparison, benzotriazole, for example, has a $pK_{sp}$ of 13.5 at a temperature of 25° C. as reported by C. J. Battaglia, *Photogr. Sci. Eng.,* 14, 275 (1970).

In a preferred embodiment, the primary source of reducible, non-photo-sensitive (or non-electron-sensitive) silver in the practice of this invention are organic silver salts described as having the lower pKsp.

The first organic silver salt, or first type of organic silver salt, is preferably a non-electron-sensitive source of reducible silver ions (that is, silver salts) and can be any compound that contains reducible silver (1+) ions. Preferably, it is a silver salt that is comparatively stable to light and electrons and forms a silver image when heated to 50° C. or higher in the presence of an exposed photocatalyst (such as silver halide) and a reducing composition. In the imaging layer of the element, the photocatalyst and the non-photosensitive source of reducible silver ions must be in catalytic proximity (that is, reactive association). "Catalytic proximity" or "reactive association" means that they should be in the same layer, or in adjacent layers. It is preferred that these reactive components be present in the same emulsion layer.

According to the present invention, the organic silver salt referred to as the "organic silver donor" or "the first organic silver salt" or "organic silver salt of the first type" is generally the oxidatively more reactive organic silver salt compared to the second organic silver salt or second type of organic silver salt. This more reactive organic silver salt is preferably a silver salt of a nitrogen acid (imine) group, which can optionally be part of the ring structure of a heterocyclic compound. Aliphatic and aromatic carboxylic acids such as silver behenate or silver benzoate, in which the silver is associated with the carboxylic acid moiety, are specifically excluded as the organic silver donor compound. Compounds that have both a nitrogen acid moiety and carboxylic acid moiety are included as donors of this invention only insofar as the silver ion is associated with the nitrogen acid rather than the carboxylic acid group. The donor can also contain a mercapto residue, provided that the sulfur does not bind silver too strongly, and is preferably not a thiol or thione compound.

More preferably, a silver salt of a compound containing an imino group present in a heterocyclic nucleus can be used. Typical preferred heterocyclic nuclei include triazole, oxazole, thiazole, thiazoline, imidazoline, imidazole, diazole, pyridine, and triazine. Examples of the first organic silver salt include derivatives of a tetrazole. Specific examples include but are not limited to 1H-tetrazole, 5-ethyl-1H-tetrazole, 5-amino-1H-tetrazole, 5-4'methoxyphenyl-1 H-tetrazole, and 5-4' carboxyphenyl-1H-tetrazole.

The organic silver salt may also be a derivative of an imidazole. Specific examples include but are not limited to benzimidazole, 5-methyl-benzimidazole, imidazole, 2-methyl-benzimidazole, and 2-methyl-5-nitro-benzimidazole. The organic silver salt may also be a derivative of a pyrazole. Specific examples include but are not limited to pyrazole, 3,4-methyl-pyrazole, and 3-phenyl-pyrazole.

The organic silver salt may also be a derivative of a triazole. Specific examples include but are not limited to benzotriazole, 1H-1,2,4-trazole, 3-amino-1,2,4 triazole, 3-amino-5-benzylmercapto-1,2,4-triazole, 5,6-dimethyl benzotriazole, 5-chloro benzotriazole, and 4-nitro-6-chlorobenzotriazole.

Other silver salts of nitrogen acids may also be used. Examples would include but not be limited to o-benzoic sulfimide, 4-hydroxy-6-methyl-1,3,3A,7-tetraazaindene, 4-hydroxy-6-methyl-1,2,3,3A,7-pentaazaindene, urazole, and 4-hydroxy-5-bromo-6-methyl-1,2,3,3A,7-pentaazaindene.

Most preferred examples of the organic silver donor compounds include the silver salts of benzotriazole, triazole, and derivatives thereof, as mentioned above and also described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, a silver salt of 1H-tetrazole as described in U.S. Pat. No. 4,220,709.

Silver salt complexes may be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The electron-sensitive silver halide grains and the organic silver salt are coated so that they are in catalytic proximity during development. They can be coated in contiguous layers, but are preferably mixed prior to coating. Conventional mixing techniques are illustrated in *Research Disclosure*, Item 17029 (June 1978), as well as U.S. Pat. No. 3,700,458 and published Japanese patent application Nos. 32928/75, 13224/74, 17216/75, and 42729/76.

Preferably, at least one organic silver donor is selected from one of the above-described compounds.

In a preferred embodiment, an oxidatively less reactive silver salt (the "second organic silver salt" or organic silver salt of the second type") is selected from silver salts of thiol or thione substituted compounds having a heterocyclic nucleus containing 5 or 6 ring atoms, at least one of which is nitrogen, with other ring atoms including carbon and up to two heteroatoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 2-mercaptobenzimidazole, a silver salt of 2-mercapto-5-aminothiadiazole, a silver salt of 5-carboxylic-1-methyl-2-phenyl-4-thiopyridine, a silver salt of mercaptotriazine, a silver salt of 2-mercaptobenzoxazole. These silver salts are herein referred to as "oxidatively less reactive silver salts."

The oxidatively less reactive silver salt may be a derivative of a thionamide. Specific examples would include but not be limited to the silver salts of 6-chloro-2-mercapto benzothiazole, 2-mercapto-thiazole, naptho(1,2-d)thiazole-2 (1H)-thione,4-methyl-4-thiazoline-2-thione, 2-thiazolidinethione, 4,5-dimethyl-4-thiazoline-2-thione, 4-methyl-5-carboxy-4-thiazoline-2-thione, and 3-(2-carboxyethyl)-4-methyl-4-thiazoline-2-thione.

Preferably, the oxidatively less reactive silver salt is a derivative of a mercapto-triazole. Specific examples would include, but not be limited to, a silver salt of 3-mercapto-4-phenyl-1,2,4 triazole and a silver salt of 3-mercapto-1,2,4-triazole.

Most preferably the oxidatively less reactive silver salt is a derivative of a mercapto-tetrazole. In one preferred embodiment, a mercapto-tetrazole compound useful in the present invention is represented by the following structure:

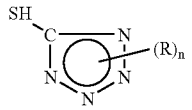

I wherein n is 0 or 1, and R is independently selected from the group consisting of substituted or unsubstituted alkyl, aralkyl, or aryl. Substituents include, but are not limited to, C1 to C6 alkyl, nitro, halogen, and the like, which substituents do not adversely affect the thermal fog inhibiting effect of the silver salt. Preferably, n is 1 and R is an alkyl having 1 to 16 carbon atoms or a substituted or unsubstituted phenyl group. Specific examples include but are not limited to silver salts of 1-phenyl-5-mercapto-tetrazole, 1-(3-acetamido)-5-mercapto-tetrazole, or 1-[3-(2-sulfo)benzamidophenyl]-5-mercapto-tetrazole.

In one embodiment of the invention, a first organic silver salt is a benzotriazole or derivative thereof and a second organic silver salt is a mercapto-functional compound, preferably mercapto-heterocyclic compound. Particularly preferred is 1-phenyl-5-mercapto-tetrazole (PMT).

In general, an organic silver salt is formed by mixing silver nitrate and other salts with the free base of the organic ligand such as PMT. By raising the pH sufficiently with alkaline base, the silver salt of PMT can be precipitated, typically in spheroids 20 nm in diameter and larger.

In a particularly preferred embodiment, the photothermographic element comprises at least one image forming layer coated on a support, wherein said layer comprises at least one silver-halide emulsion, optionally chemically and spectrally sensitized to visible or infrared radiation (to record metadata, for example, magnification and negative number, employing a diode or the like), an organic silver salt having Structure (IA) below, a silver salt having Structure (II) below, an optional thermal solvent selected from Structures (IIIA–IIIC) below, a phenolic coupler of Structure (IV) below, and an amine developer or precursor thereof having Structure (V) below. Such an element is capable of producing a positive image after a single exposure and single thermal development unit step.

The silver salt of Structure (IA) has the general structure:

(IA)

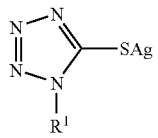

wherein $R^1$ is alkyl, cycloalkyl, substituted alkyl, phenyl, aryl, substituted aryl or phenyl.

The silver salt of Structure (II) has the general structure:

(II)

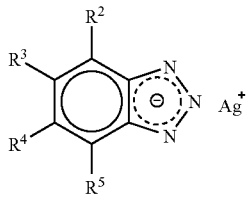

wherein $R^2$, $R^3$, $R^4$, and $R^5$ may be independently selected from hydrogen, halide, alkyl, alkoxy, aryl, phenyl, phenoxy, carboxy, alkyl, cycloalkyl, substituted alkyl, substituted aryl, substituted phenyl, wherein said substituted alkyl, aryl or phenyl groups may also contain O, N, S, halide, sulfonic acid, sulfone, sulfonamide, carboxylic acid, ester, aldehyde, ketone, amine, or amide; and wherein at least two of $R^2$, $R^3$, $R^4$, and $R^5$ may be part of an additional ring structure.

In another embodiment mixed silver salts of the organic ligands used to make Structure (I) and Structure (II) may be preferred over the individual salts. An example is a mixed salt comprising silver, benzotriazole, and PMT in the molar ratio of 1:0.5:0.5. Prior art thermal solvents for a heat processed photographic elements are disclosed in U.S. Pat. No. 6,277,537, U.S. Pat. No. 5,436,109; U.S. Pat. No. 5,843,618, U.S. Pat. No. 5,480,761, U.S. Pat. No. 5,480,760, U.S. Pat. No. 5,468,587, U.S. Pat. No. 5,352,561, U.S. Pat. No. 5,064,742. These are also useful in the current invention although optional. When used, preferred thermal solvents have a hydroxy-benzamide structure as shown in Structures (IIIA)–(IIIC):

(IIIA)

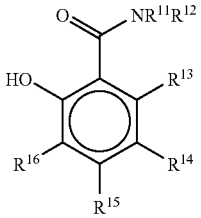

(IIIB)

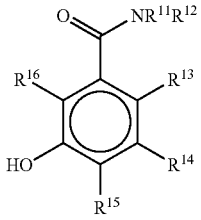

(IIIC)

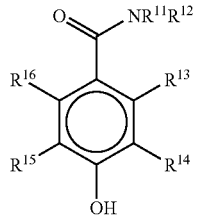

wherein $R^{11}$, $R^{12}$, $R^{13}$, $R^{14}$, $R^{15}$, and $R^{16}$, which can be the same or different individually, can be hydrogen, alkyl, substituted alkyl, alkenyl, substituted alkenyl, aryl, substituted aryl, halogen, cyano, alkoxy, substituted alkoxy, aryloxy, substituted aryloxy, amino, substituted amino, alkylcarbonamido, substituted alkylcarbonamido, arylcarbonamido, substituted arylcarbonamido, alkylsulfonamido, arylsulfonamido, substituted alkylsulfonamido, substituted arylsulfonamido, or sulfamyl; or wherein at least two of $R^{11}$, $R^{12}$, $R^{13}$, $R^{14}$, $R^{15}$, and $R^{16}$ together can further form a substituted or unsubstituted carbocyclic or heterocyclic ring structure that can further be substituted or unsubstituted.

Representative thermal solvents include:

TS-1

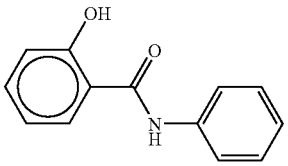

TS-2

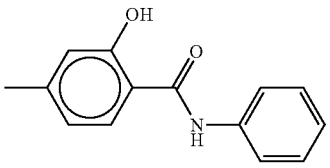

-continued

TS-3

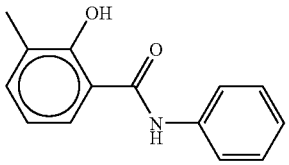

TS-4

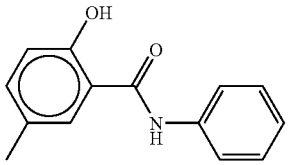

TS-5

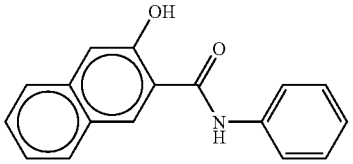

TS-6

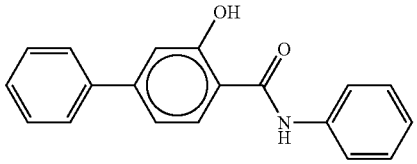

TS-7

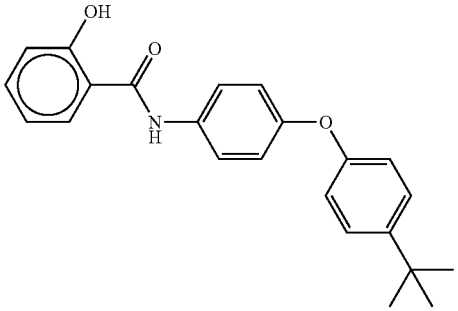

The phenolic coupler of Structure (IV) has the general structure:

(IV)

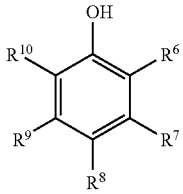

wherein $R^6$, $R^7$, $R^8$, $R^9$ and $R^{10}$ may independently be selected from hydrogen, hydroxyl, alkyl, alkoxy,

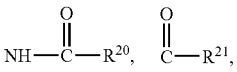

NH—$SO_2R^{22}$, $SO_2NHR^{23}$, wherein $R^{20}$, $R^{21}$, $R^{22}$, $R^{23}$ are independently selected from alkyl, haloalkyl, hydroxyl, amino, substituted amino, arylamino, substituted arylamino, aryl, substituted aryl, phenyl, substituted phenyl, alkoxy, aryloxy, substituted aryloxy, phenoxy, and substituted phenoxy, or wherein at least two of $R^7$, $R^8$, and $R^9$ together can further form a substituted or unsubstituted carbocyclic or heterocyclic ring structure. Such compounds are exemplified by, and include all the couplers disclosed in GB 2018453A to Willis, hereby incorporated by reference in its entirety.

Such couplers have the property that they are relatively inactive as couplers. This allows them to function as Dox scavengers to maximize Dmax in the positive image while, at the same time, minimizing the Dmin (or Dmax of the temporary or low-contrast negative image) during thermal development.

Some phenolic couplers may also behave as thermal solvents. It is preferable that one material satisfy more than one function, but it is not necessary.

Examples of phenolic couplers include:

PC-1

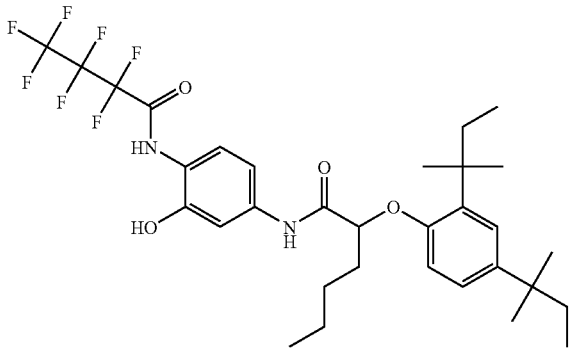

PC-2

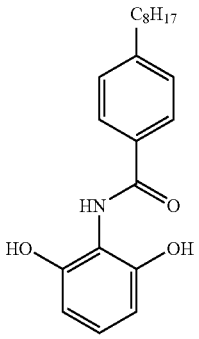

PC-3

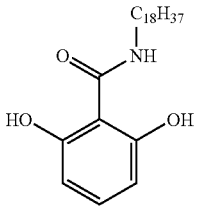

-continued

PC-4

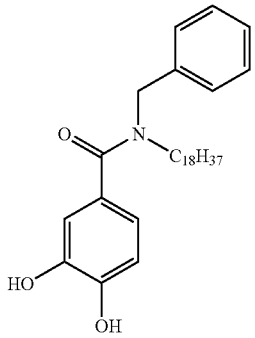

As indicated above, a photothermographic process typically employs blocked developers that decompose (i.e., unblock) on thermal activation to release a developing agent. A "dry thermal process" or "dry photothermographic" process is defined as a process involving, after imagewise exposure of the photothermographic element, developing the resulting latent image by the use of heat to raise the temperature of the photothermographic element or film to a temperature of at least about 150° C., preferably at least about 155° C., more preferably at about 160° C. to 180° C., without liquid processing of the film, preferably in an essentially dry process without the application of aqueous solutions. An essentially dry process is defined as a process that does not involve the uniform saturation of the film with a liquid, solvent, or aqueous solution. Thus, contrary to photothermographic processing involving low-volume liquid processing, the amount of water required is less than 1 times, preferably less than 0.4 times and more preferably less than 0.1 times the amount required for maximally swelling total coated layers of the film excluding a back layer. Most preferably, no liquid is required or applied or added to the film during thermal treatment. Preferably, no laminates are required to be intimately contacted with the film in the presence of aqueous solution.

Preferably, during thermal development an internally located blocked developing agent in reactive association with each of light-sensitive layers becomes unblocked to form a developing agent, whereby the unblocked developing agent is imagewise oxidized on development and this oxidized form reacts with the dye-providing couplers or other Dox scavenger.

The components of the photothermographic element can be in any location in the element that provides the desired image. If desired, one or more of the components can be in one or more layers of the element. For example, in some cases, it is desirable to include certain percentages of the reducing agent, toner, thermal solvent, stabilizer and/or other addenda in the overcoat layer over the photothermographic image-recording layer of the element. This, in some cases, reduces migration of certain addenda in the layers of the element.

It is necessary that the components of the photographic combination be "in association" with each other in order to produce the desired image. The term "in association" herein means that in the photothermographic element the photographic silver halide and other components of the image-forming combination are in a location with respect to each other that enables the desired processing and forms a useful image. This may include the location of components in different layers.

Preferably, development processing is carried out (i) for less than 60 seconds, (ii) at the temperature from 150 to 200° C., and (iii) without the application of any aqueous solution.

In view of advances in the art of scanning technologies, it has now become natural and practical for photothermographic films such as disclosed in EP 0762 201 to be scanned, which can be accomplished without the necessity of removing the silver or silver halide from the negative, although special arrangements for such scanning can be made to improve its quality. See, for example, Simons U.S. Pat. No. 5,391,443. A method for the scanning of such films are also disclosed in commonly assigned U.S. Pat. No. 6,521,384, issued Feb. 18, 2003, hereby incorporated by reference in its entirety.

A simple technique is to scan the photographic element point-by-point along a series of laterally offset parallel scan paths. A sensor that converts radiation received into an electrical signal notes the intensity of light passing through the element at a scanning point. Most generally this electronic signal is further manipulated to form a useful electronic record of the image. For example, the electrical signal can be passed through an analog-to-digital converter and sent to a digital computer together with location information required for pixel (point) location within the image. The number of pixels collected in this manner can be varied as dictated by the desired image quality. Very low resolution images can have pixel counts of 192×128 pixels per film frame, low resolution 384×256 pixels per frame, medium resolution 768×512 pixels per frame, high resolution 1536×1024 pixels per frame and very high resolution 3072×2048 pixels per frame or even 6144×4096 pixels per frame or even more. Higher pixel counts or higher resolution translates into higher quality images because it enables higher sharpness and the ability to distinguish finer details especially at higher magnifications at viewing. These pixel counts relate to image frames having an aspect ratio of 1.5 to 1. Other pixel counts and frame aspect ratios can be employed as known in the art. Most generally, a difference of four times between the number of pixels rendered per frame can lead to a noticeable difference in picture quality, while differences of sixteen times or sixty four times are even more preferred in situations where a low quality image is to be presented for approval or preview purposes but a higher quality image is desired for final delivery to a customer. On digitization, these scans can have a bit depth of between 6 bits per color per pixel and 16 bits per color per pixel or even more. The bit depth can preferably be between 8 bits and 12 bits per color per pixel. Larger bit depth translates into higher quality images because it enables superior tone and color quality.

Both large and small format frames are used in electron microscopy. Most electron microscopy is done with monochrome films and the image is digitized using a 12 bit or 14 bit grey scale.

The electronic signal can form an electronic record that is suitable to allow reconstruction of the image into viewable forms such as computer monitor displayed images, television images, optically, mechanically or digitally printed images and displays and so forth all as known in the art. The formed image can be stored or transmitted to enable further manipulation or viewing, such as in U.S. Ser. No. 09/592,816 titled AN IMAGE PROCESSING AND MANIPULATION SYSTEM to Richard P. Szajewski, Alan Sowinski and John Buhr.

The support for the photothermographic element is preferably transparent. It can be colorless or tinted and can take the form of any conventional support currently employed in photographic film elements—e.g., a colorless or tinted transparent film support. Details of support construction are well understood in the art. Examples of useful supports are poly(vinylacetal) film, polystyrene film, poly(ethylene-terephthalate) film, poly(ethylene naphthalate) film, polycarbonate film, and related films and resinous materials, as well as paper, cloth, glass, metal, and other supports that withstand the anticipated processing conditions.

The element can contain additional layers, such as overcoat layers, subbing layers, and the like. Transparent support constructions, including subbing layers to enhance adhesion, are disclosed in Section XV of *Research Disclosure* I.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Any convenient selection from among conventional light and/or electron-sensitive silver-halide emulsions can be incorporated within the layer units and used to provide the electron absorptances of the invention. Most commonly, high bromide emulsions containing a minor amount of iodide are employed. Silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thickness are less than 0.3 μm (most preferably less than 0.2 μm). Ultra thin tabular grain emulsions, those with mean tabular grain thickness of less than 0.07 μm, are specifically contemplated. The grains preferably form surface latent images so that they are capable of producing negative images when processed in a solution surface developer.

Illustrations of conventional electron or light-sensitive silver halide emulsions are provided by *Research Disclosure* I, cited above. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII, Antifoggants and stabilizers.

The silver-halide grains to be used in the invention may be prepared according to methods known in the art, such as those described in *Research Disclosure* I, cited above, and T. H. James, *The Theory of the Photographic Process*, Fourth Edition, Macmillan Publishing Co., Inc., 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure* I, Section I. Emulsion grains and their preparation, subsection G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al. U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure*, Item 36736, November 1994, herein incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure* I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

The photographic elements may further contain other image-modifying compounds such as "Development-Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613. DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

Optionally, it is possible to coat one, two or three separate emulsion layers within a single image-forming layer unit. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing electron-beam and the slowest emulsion be located nearest the support.

The photothermographic element may comprise an antihalation layer unit that contains a decolorizable light or electron absorbing material, such as one or a combination of pigments and dyes. Suitable materials can be selected from among those disclosed in *Research Disclosure* I, Section VIII. Absorbing materials.

The photothermographic element may further comprise a surface overcoat SOC that are typically hydrophilic colloid layers that are provided for physical protection of the elements during handling and processing. Each SOC also provides a convenient location for incorporation of addenda that are most effective at or near the surface of the element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure* I, Section IX. Coating physical property modifying addenda. The SOC overlying the emulsion layers optionally contains an ultraviolet absorber, such as illustrated by *Research Disclosure* I, Section VI. UV dyes/optical brighteners/luminescent dyes, paragraph (1).

The photothermographic elements of the present invention are preferably of type B as disclosed in *Research Disclosure* I. Type B elements contain in reactive association a photosensitive silver halide, a reducing agent or developer, optionally an activator, a coating vehicle or binder, and a salt or complex of an organic compound with silver ion. In these systems, this organic complex is reduced during development to yield silver metal, the organic silver salt is referred to as the silver donor. References describing such imaging elements include, for example, U.S. Pat. Nos. 3,457,075; 4,459,350; 4,264,725; and 4,741,992. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

The photosensitive silver-halide grains and the organic silver salts of the present invention can be coated so that they are in catalytic proximity during development. They can be coated in contiguous layers, but are preferably mixed prior to coating. Conventional mixing techniques are illustrated by *Research Disclosure*, Item 17029 (June 1978), as well as U.S. Pat. No. 3,700,458 and published Japanese patent applications Nos. 32928/75, 13224/74, 17216/75, and 42729/76.

Optionally blocked developers can be used in photographic elements of the present invention and include, but are not limited to, the blocked developing agents described in U.S. Pat. No. 3,342,599, to Reeves; *Research Disclosure* (129 (1975) pp. 27–30); U.S. Pat. No. 4,157,915, to Hamaoka et al.; U.S. Pat. No. 4,060,418, to Waxman and Mourning; and in U.S. Pat. No. 5,019,492. Particularly useful are those blocked developers described in U.S. Pat. Nos. 6,506,546; 6,306,551; 6,426,179; and 6,312,879. Further improvements in blocked developers are disclosed in U.S. Pat. Nos. 6,413,708; 6,543,226; 6,319,640; and 6,537,712. Yet other improvements in blocked developers and their use in photothermographic elements are found in U.S. Pat. Nos. 6,506,528 and 6,472,111.

In one embodiment of the invention, blocked developer for use in the present invention may be represented by the following Structure V:

$$DEV\text{—}(\text{LINK 1})_l\text{—}(\text{TIME})_m\text{—}(\text{LINK 2})_n\text{—}B \qquad \text{V}$$

wherein,

DEV is a silver halide developing agent;

LINK 1 and LINK 2 are linking groups;

TIME is a timing group;

1 is 0 or 1;

m is 0, 1, or 2;

n is 0 or 1;

1+n is 1 or 2;

B is a blocking group or B is:

$$\text{—}B'\text{—}(\text{LINK 2})_n\text{—}(\text{TIME})_m\text{—}(\text{LINK 1})_l\text{—}DEV$$

wherein B' also blocks a second developing agent DEV.

In a preferred embodiment of the invention, LINK 1 or LINK 2 are of Structure VI:

VI

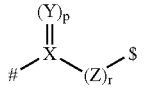

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

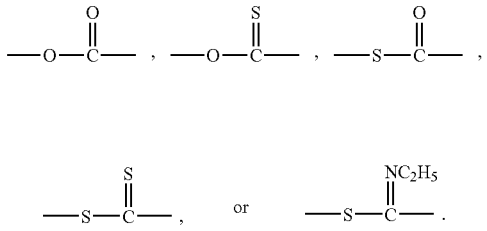

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Other blocked developers that can be used are, for example, those blocked developers disclosed in U.S. Pat. No. 6,303,282 B1 to Naruse et al., U.S. Pat. No. 4,021,240 to Cerquone et al., U.S. Pat. No. 5,746,269 to Ishikawa, U.S. Pat. No. 6,130,022 to Naruse, and U.S. Pat. No. 6,177,227 to Nakagawa, and substituted derivatives of these blocked developers. Although the present invention is not limited to any type of developing agent or blocked developing agent, the following are merely some examples of some photographically useful blocked developers that may be used in the invention to produce developers during heat development.

D-1

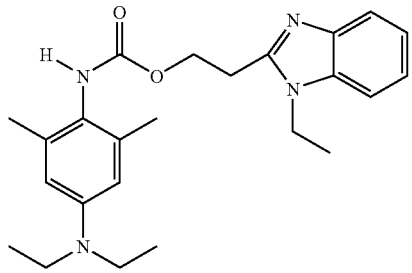

-continued
D-2
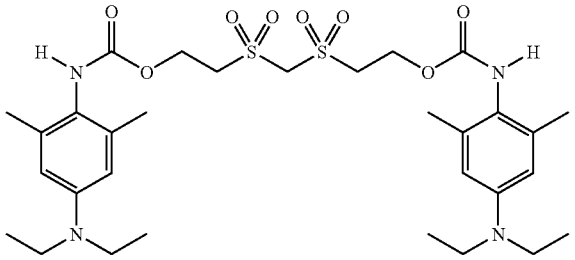
D-3
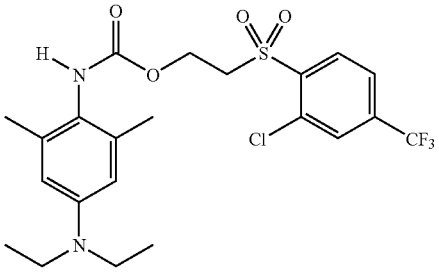
D-4
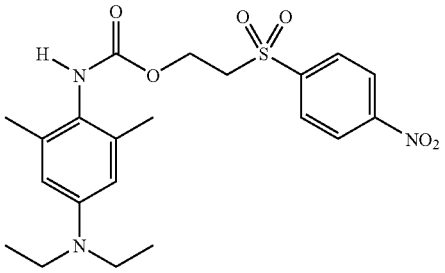
D-5
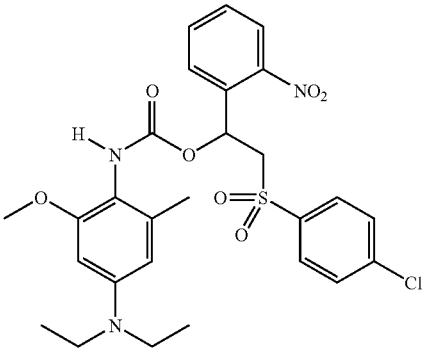
D-6
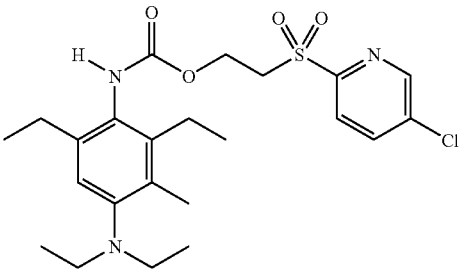
-continued
D-7
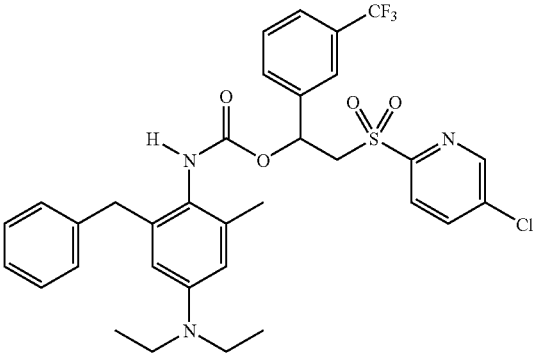
D-8
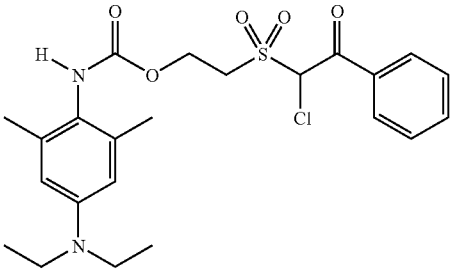
D-9
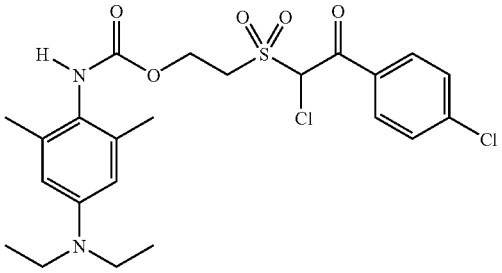
D-10
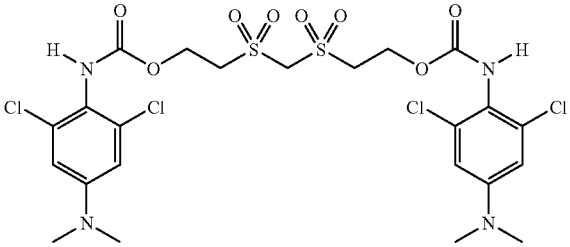
D-11
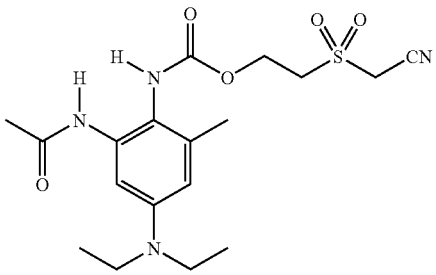

-continued

D-12

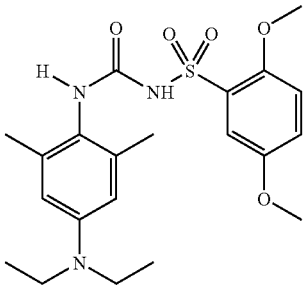

D-13

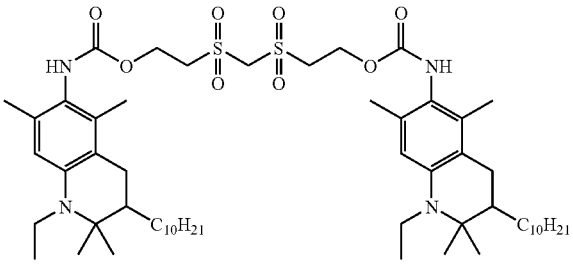

D-14

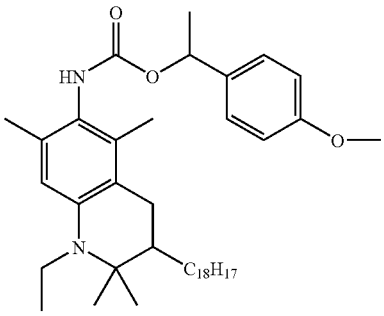

D-15

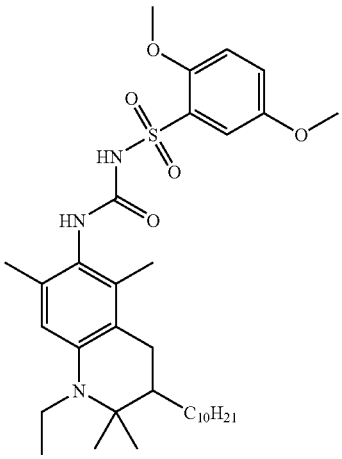

-continued

D-16

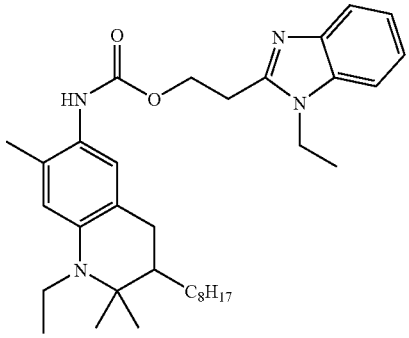

D-17

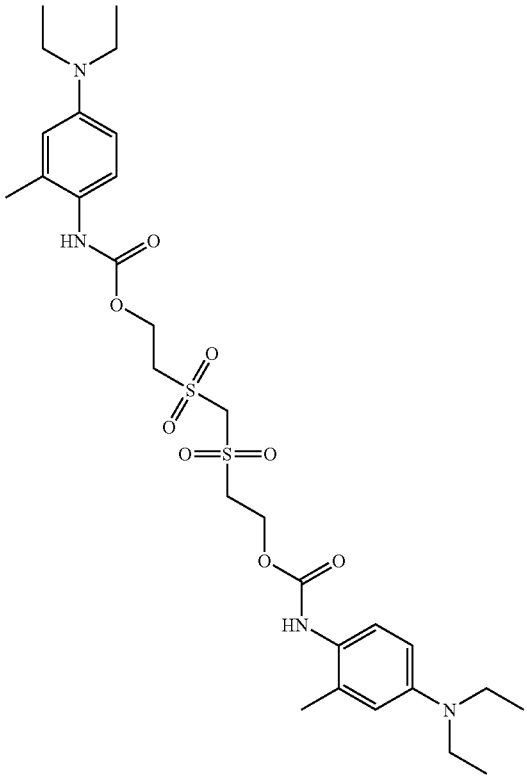

The blocked developer can be incorporated in one or more of the imaging layers of the imaging element. The amount of blocked developer used is preferably 0.01 to 5 g/m$^2$, more preferably 0.1 to 2 g/m$^2$ and most preferably 0.3 to 2 g/m$^2$ in each layer to which it is added.

After imagewise exposure of the imaging element, the blocked developer is activated during processing of the imaging element by the presence of acid or base, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure* I. Such chemicals include, for example, sulfites, hydroxylamine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

A reducing agent in addition to, or instead of, the blocked developer may be included in the photothermographic element. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 1 to 25 percent of the photothermographic layer.

A wide range of reducing agents has been disclosed in dry silver systems including amidoximes such as phenylamidoxime, 2-thienylamidoxime and p-phenoxy-phenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; bis-naphthols as illustrated by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzene-sulfon-amido-phenol, and p-benzenesulfonamidophenol; 2-phenylindane-1, 3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

It is contemplated that the photothermographic element contains a thermal solvent. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure*, June 1978, Item No. 17029 and U.S. Pat. No. 4,123,282.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as latex or other fine particle dispersion.

Photothermographic elements as described can contain addenda that are known to aid in formation of a useful image. The photothermographic element can contain development modifiers that function as speed increasing compounds, sensitizing dyes, hardeners, anti-static agents, plasticizers and lubricants, coating aids, brighteners, absorbing and filter dyes, such as described in *Research Disclosure*, December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis(tribromomethyl)-s-triazines, such as 6-methyl or 6-phenyl-2,4-bis(tribromomethyl)-s-triazine.

Imagewise exposure is preferably for a time and intensity sufficient to produce a developable latent image in the photothermographic element.

After imagewise exposure of the photothermographic element, the resulting latent image can be developed in a variety of ways. The simplest is by overall heating the element to thermal processing temperature. Heating means known in the photothermographic arts are useful for providing the desired processing temperature for the exposed photothermographic element. The heating means is, for example, a simple hot plate, iron, roller, heated drum, microwave heating means, heated air, vapor or the like. It is contemplated that the design of the processor for the photothermographic element be compatible to the design of the cassette, cartridge, or film packet used for storage and use of the element. Further, data stored on the film or cartridge may be used to modify processing conditions or scanning of the element. Methods for accomplishing these steps in the imaging system are disclosed in commonly assigned, copending U.S. Pat. Nos. 6,062,746 and 6,048,110, which are incorporated herein by reference. The use of an apparatus whereby the processor can be used to write information onto the element, information which can be used to adjust processing, scanning, and image display is also envisaged. This system is disclosed in U.S. Pat. No. 6,278,510, hereby incorporated herein by reference.

Thermal processing is preferably carried out under ambient conditions of pressure and humidity. Conditions outside of normal atmospheric pressure and humidity may be used.

It is contemplated that imaging elements of this invention may be scanned prior to optional removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, which employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al. U.S. Pat. No. 5,649,260, Koeng at al. U.S. Pat. No. 5,563,717, and by Cosgrove et al. U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The following examples illustrate the practice of this invention. They are not intended to be exhaustive of all possible variations of the invention. Parts and percentages are by weight unless otherwise indicated.

EXAMPLES

Silver Salt Dispersion SS-1:

A stirred reaction vessel was charged with 480 g of lime processed gelatin and 5.6 l of distilled water. A solution containing 0.7 M silver nitrate was prepared (Solution A). A solution containing 0.7 M benzotriazole and 0.7 M NaOH was prepared (Solution B). The mixture in the reaction vessel was adjusted to a pAg of 7.25 and a pH of 8.00 by additions of Solution B, nitric acid, and sodium hydroxide as needed.

Solution A was added with vigorous mixing to the kettle at 38 cc/minute, and the pAg was maintained at 7.25 by a simultaneous addition of solution B. This process was continued until the quantity of silver nitrate added to the vessel was 3.54 M, at which point the flows were stopped and the mixture was concentrated by ultrafiltration. The resulting silver salt dispersion contained fine particles of silver benzotriazole.

Silver Salt Dispersion SS-2:

A stirred reaction vessel was charged with 480 g of lime processed gelatin and 5.6 l of distilled water. A solution containing 0.7 M silver nitrate was prepared (Solution A). A solution containing 0.7 M 1-phenyl-5-mercaptotetrazole and 0.7 M NaOH was also prepared (Solution B). The mixture in the reaction vessel was adjusted to a pAg of 7.25 and a pH of 8.00 by additions of Solution B, nitric acid, and sodium hydroxide as needed.

Solution A was added to the kettle at 19.6 cc/minute, and the pAg was maintained at 7.25 by a simultaneous addition of solution B. This process was continued until the 3.54 moles of silver nitrate had been added to the vessel, at which point the flows were stopped and mixture was concentrated by ultrafiltration. The resulting silver salt dispersion contained fine particles of the silver salt of 1-phenyl-5-mercaptotetrazole.

Preparation of Silver Bromoiodide Emulsion E-2:

Emulsion E-2 is a silver bromoiodide emulsion containing tabular grains having a mean equivalent circular diameter of 0.6 μm. The emulsion was optimally chemically sensitized with sulfur and gold and spectrally pan-sensitized using known methods in the art with sensitizing dyes GSD-2, GSD-3 and GSD-4 in the relative amounts listed in Table 1.

TABLE 1

GSD-2 (0.138 g/mol silver)

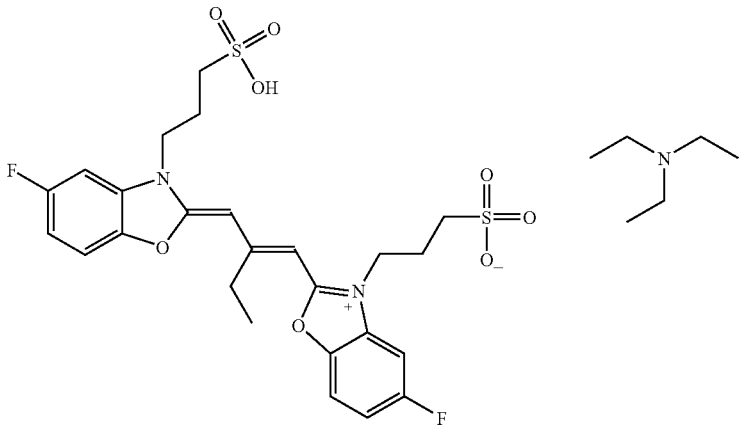

GSD-3 (0.04 g/mol silver)

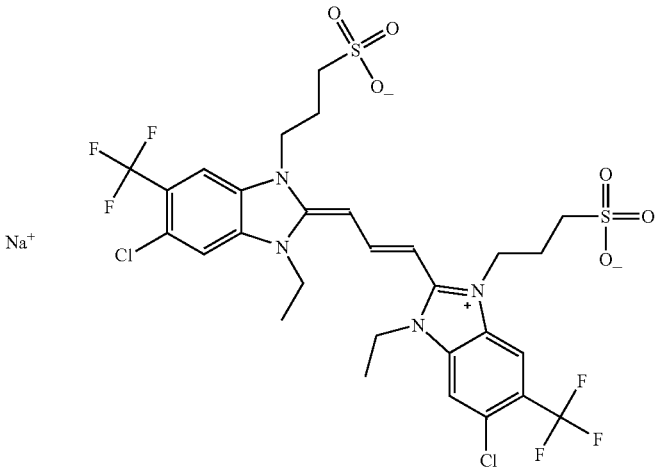

GSD-4 (0.231 g/mol silver)

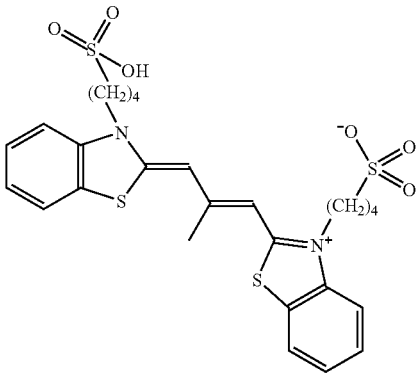

Developer Dispersion, DD-1:

A dispersion of developer D-17 was prepared by the method of ball milling. For each gram of incorporated developer, 0.2 g of sodium tri-isopropylnaphthalene sulfonate, 10 g of water, and 25 ml of beads were added. Following milling, the zirconia beads were removed by filtration. The slurry was refrigerated prior to use.

D-17

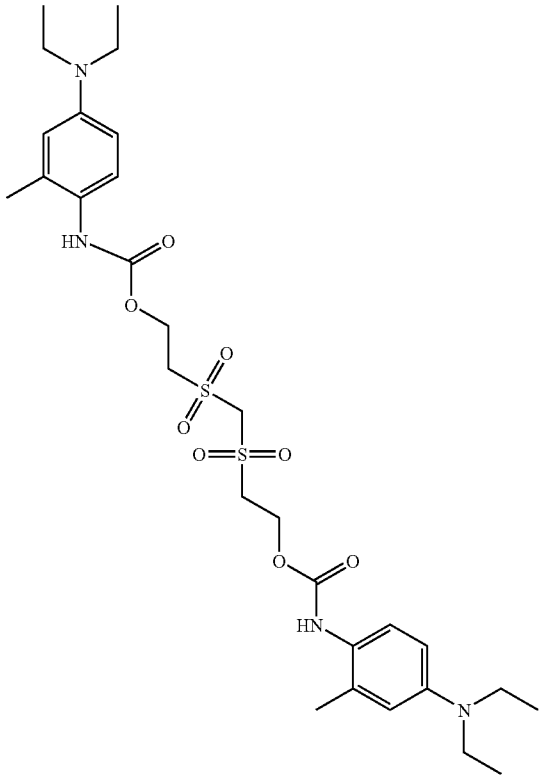

Thermal Solvent Dispersion, TSD-1:

A dispersion of salicylanilide (TS-1) was prepared by the method of ball milling. A total of 19 g of slurry was produced by combining 3.0 gm TS-1 solid, 0.20 g polyvinyl pyrrolidone, 0.20 g TRITON X-200 surfactant, and 15.6 g distilled water. To this mixture was added 20 ml of zirconia beads. The slurry was ball milled for 48 hours. Following milling, the zirconia beads were removed by filtration. At this point, 1 g of gelatin was added, allowed to swell, and then dissolved in the mixture by heating at 40 C. The resulting mixture was chill set to yield a dispersion containing 5% gelatin and 15% TS-1.

Phenolic Coupler Dispersion PCD-1:

A dispersion of catechol PC-4 was prepared by the method of ball milling. A slurry was produced by combining 20 g PC-4 solid, 17.5 g of 10% polyvinyl pyrrolidone, 2.5 g of 9.14% Pionin A44SP, and 162.5 g distilled water. To this mixture was added 475 ml of 1.8 mm zirconia beads. The slurry was ball milled for 72 hours. Following milling, the zirconia beads were removed by filtration.

PC-4

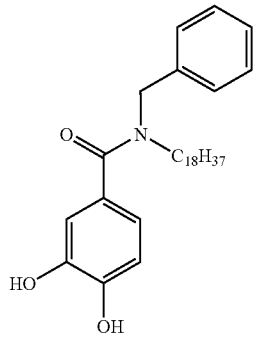

Example 1

The following aqueous multilayer coating, in Table 2, was prepared using negative-working emulsion E-2 according to methods known in the art. The support was 0.018 cm (0.007 inch) thick poly(ethylene terephthalate).

TABLE 2

| Component | g/m$^2$ |
|---|---|
| Layer 1: Interlayer | |
| Gelatin | |
| Ethene, 1,1'-(methylenebis(sulfonyl))bis- | 0.14 |
| Layer 2: Imaging Layer | |
| Pan-Sensitive Silver (from emulsion E-2) | 0.54 |
| Silver (from silver salt SS-1) | 1.08 |
| Silver (from silver salt SS-2) | 1.08 |
| Phenolic Coupler PC-4 (from PCD-1) | 1.08 |
| Developer D-17 (from DD-1) | 1.08 |
| Salicylanilide (from TSD-1) | 2.16 |
| Gelatin | 6.88 |
| Layer 3: Overcoat | |
| Gelatin | 3.23 |
| Surfactant SF-1 | 0.01 |
| Ludox ® AM (colloidal silica) | 0.15 |

Example 2

Example 2 shows the advantage of the Invention Example 1 relative to a Comparison film SO-163 when exposed using a transmission electron microscope. Invention Example 1 incorporates a pan-sensitive emulsion. The exposure was adjusted to optimal conditions for the Comparison film SO-163. Under these conditions Comparison film SO-163 requires a 2 sec exposure while the invention film required a 1 sec exposure. The test object was a biological sample. After exposing, the comparison film was wet processed using D-19 developer for 4 minutes, followed by a 30 second water rinse, followed by a 4 minute rapid fix, and finally washed in water for 20 min, and dried. The resulting negative was scanned, then gray-scaled and then inverted to a positive image in PHOTOSHOP software. The final image was printed on a KODAK thermal printer on reflection media. Invention Example 1 was processed by heating for 24 seconds at 162° C. The positive image was scanned, gray scaled and contrast adjusted in PHOTOSHOP software, and the final image was printed using a Kodak thermal printer on reflection media. The image quality was comparable.

The invention has been described in detail with particular reference to preferred embodiments, but it will be understood that variations and modifications can be effected within the spirit and scope of the invention.

PARTS LIST:

| | |
|---|---|
| 10 | TEM instrument |
| 12 | cabinet-like base |
| 14 | electron-beam focusing column |
| 16 | specimen receptor |
| 18 | electron-beam generating head or electron gun |
| 20 | observation port |
| 22 | drawer |
| 24 | drawer |
| 26 | film supply box |
| 28 | film receiver box |
| 30 | individual film unit |
| 32 | individual film sheets |
| 34 | shipping carton |
| 36 | carrier plate or holder |
| 38 | darkroom |
| 40 | light-tight cover or dark slide |
| 42 | vacuum chamber |

The invention claimed is:

1. A method of forming a positive image in a photothermographic film by employing a transmission electron microscope in which, under vacuum, an electron beam proceeds from a source of electrons to illuminate an object to be imaged, and an image formation lens system forms an enlarged transmission latent image of the object in the photothermographic film, wherein the photothermographic film has at least one imaging layer comprising a potentially negative-working silver-halide emulsion, the method further comprising processing of imagewise exposed film in which thermal development of unexposed silver salts in exposed areas is effectively inhibited relative to unexposed areas, thereby producing a positive image in the photothermographic film.

2. The method of claim 1, wherein the at least one imaging layer further comprises a developer or precursor thereof and an oxidized-developer scavenging agent to accelerate development by removing oxidized developer as it is formed during the thermal development.

3. The method of claim 1 wherein the photothermographic film is imagewise exposed with a non-solarizing amount of energy to form a latent image and wherein the latent image is completely developed to a positive image in a single thermal development unit step to produce a positive image in the photothermographic film.

4. The method of claim 1 wherein the thermal development of unexposed silver salts in the exposed areas is inhibited relative to the unexposed areas by a density-inhibiting agent.

5. The method of claim 4 wherein the density-inhibiting agent is released by a precursor compound during the thermal development.

6. The method of claim 1 wherein the at least one imaging layer comprises a silver-halide emulsion and at least one non-electron-sensitive organic silver salt, the method comprising, following thermal development of the imagewise exposed film, forming imagewise reduced silver that is physically separate and morphologically distinct from a developed latent-image silver associated with silver-halide grains in the silver-halide emulsion.

7. The method of claim 1 comprising, following the thermal development, the following steps:

scanning the developed positive image to form an analog electronic representation of the developed image;

digitizing an analog electronic representation to form a digital image;

digitally modifying the digital image; and storing, transmitting, printing, or displaying the modified digital image.

8. The method of claim 1, wherein the photothermographic film is a black-and-white film.

9. The method of claim 1 wherein the potentially negative-working silver-halide emulsion comprises primarily tabular grains.

10. The method of claim 1, wherein the photothermographic film comprises at least one electron-sensitive imaging layer comprising a potentially negative-working emulsion that comprises electron-sensitive silver halide, one or more non-electron-sensitive organic silver salts, and wherein the photothermographic material is thermally developed without any externally applied developing agent by heating the photothermographic film in a thermal processor to a temperature greater than 150° C. in an essentially dry process to form a positive image in the at least one imaging layer, said method further comprising scanning the positive image to provide a digital electronic record capable of generating a positive or a negative image in a display element.

11. The method of claim 10 wherein the photothermographic film further comprises a developing agent or precursor thereof and an effective amount of a Dox scavenger for removing oxidized developer as it is being formed during thermal development.

12. The method of claim 1 wherein the photothermographic film is framed within a carrier prior to exposure.

13. The method of claim 1 wherein accelerating voltage of the transmission electron microscope used to produce electrons for imaging is in the range of about 100 keV to 1 MeV.

14. The method of claim 1 wherein the electron beam used to illuminate the object is a fine beam of high-energy primary electrons of controlled energy and wherein the source of electrons is an electron gun.

15. The method of claim 1 wherein the transmission electron microscope is capable of a total magnification in at least the range of 2,500× to 800,000×.

16. The method of claim 1 wherein the transmission electron microscope comprises (a) a column in which a series of electromagnetic lenses is positioned, and (b) a camera chamber in which the photothermographic film is positioned during imagewise exposure to imaging electrons.

17. The photothermographic film of claim 1 wherein upon thermal development the ratio of density produced in an unexposed area to density produced in a highest exposed area is greater than 1.1.

18. The method of claim 1 wherein the object that is imaged is a medical, pathological, or biological specimen.

19. The method of claim 1 wherein the object that is imaged is a metallurgical or other specimen of material science used for industrial applications.

20. The method of claim 1 wherein the silver-halide emulsion is effectively optimized for sensitivity to electrons produced in a transmission electron microscope.

* * * * *